US008419005B2

(12) United States Patent
Nomiyama et al.

(10) Patent No.: US 8,419,005 B2
(45) Date of Patent: Apr. 16, 2013

(54) BANKNOTE HANDLING APPARATUS

(75) Inventors: Akira Nomiyama, Mito (JP); Eisuke Shiomi, Nagakute (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 306 days.

(21) Appl. No.: 12/332,387

(22) Filed: Dec. 11, 2008

(65) Prior Publication Data

US 2009/0152805 A1 Jun. 18, 2009

(30) Foreign Application Priority Data

Dec. 12, 2007 (JP) ..... 2007-320314

(51) Int. Cl.
*B65H 83/00* (2006.01)

(52) U.S. Cl.
USPC ..... 271/3.02; 271/3.12; 271/177

(58) Field of Classification Search ..... 271/177, 271/178, 179, 3.02, 3.12, 248, 315
See application file for complete search history.

(56) References Cited

U.S. PATENT DOCUMENTS

| | | | | |
|---|---|---|---|---|
| 3,817,516 | A * | 6/1974 | Lazzarotti et al. | 271/150 |
| 4,167,227 | A * | 9/1979 | Pichon et al. | 198/456 |
| 4,252,308 | A * | 2/1981 | Templeton | 271/179 |
| 4,295,645 | A * | 10/1981 | Nahar et al. | 271/34 |
| 4,378,938 | A * | 4/1983 | Staniszewski | 271/179 |
| 4,757,985 | A * | 7/1988 | Hamant et al. | 271/31.1 |
| 4,884,795 | A * | 12/1989 | Vander Syde | 271/34 |
| 5,219,432 | A * | 6/1993 | Delbe et al. | 271/103 |
| 5,297,785 | A * | 3/1994 | Ricciardi | 271/3.18 |
| 5,413,323 | A * | 5/1995 | Imbert et al. | 271/149 |
| 5,556,251 | A | 9/1996 | Hiroi et al. | |
| 5,575,464 | A * | 11/1996 | Martinez et al. | 271/2 |
| 6,513,804 | B2 * | 2/2003 | Baumann et al. | 271/264 |
| 6,779,728 | B2 * | 8/2004 | Nomiyama et al. | 235/485 |
| 7,731,014 | B2 * | 6/2010 | Berdelle-Hilge et al. | 198/608 |
| 2003/0047601 | A1 | 3/2003 | Nomiyama et al. | |
| 2007/0132178 | A1 * | 6/2007 | Marcinik et al. | 271/226 |

FOREIGN PATENT DOCUMENTS

| | | |
|---|---|---|
| CN | 1990367 | 7/2007 |
| JP | 48075378 | 9/1973 |
| JP | 49083769 | 7/1974 |

(Continued)

OTHER PUBLICATIONS

Office Action in CN 100037, dated Aug. 11, 2010 (in Chinese) [4 pgs].

(Continued)

*Primary Examiner* — Kaitlin Joerger
*Assistant Examiner* — Ernesto Suarez
(74) *Attorney, Agent, or Firm* — Antonelli, Terry, Stout & Kraus, LLP.

(57) ABSTRACT

There is provided a paper sheet handling apparatus capable of processing a deviated banknote in a banknote storage bin so as to displace the banknote to an optional position. The banknote handling apparatus incorporates a deviation processing means making contact with at least one side of a banknote in a paper sheet storage bin in which banknotes are stacked one upon another, for applying a force to the banknote at least in a direction of deviation of the banknote. The deviation processing means falls, during operation thereof, either in a condition in which it makes contact with a paper sheet in the paper sheet storage bin or in a condition in which it does not make contact therewith.

5 Claims, 11 Drawing Sheets

FOREIGN PATENT DOCUMENTS

| | | |
|---|---|---|
| JP | 58-22490 | 2/1983 |
| JP | 58161946 | 10/1983 |
| JP | 59-92972 | 6/1984 |
| JP | 3-264457 | 11/1991 |
| JP | 8-96218 | 4/1996 |
| JP | 2000-016597 | 1/2000 |
| JP | 2002-56431 | 2/2002 |
| JP | 2002-170146 | 6/2002 |
| JP | 2003-128276 | 5/2003 |

OTHER PUBLICATIONS

Extended European Search Report in EP08021634.4-1256/2070854, dated Mar. 24, 2011; [4 pages in English].

Office Action in JP 2008-306884, dispatched Dec. 11, 2012, (in Japanese, 2 pages).

* cited by examiner

FIG.9
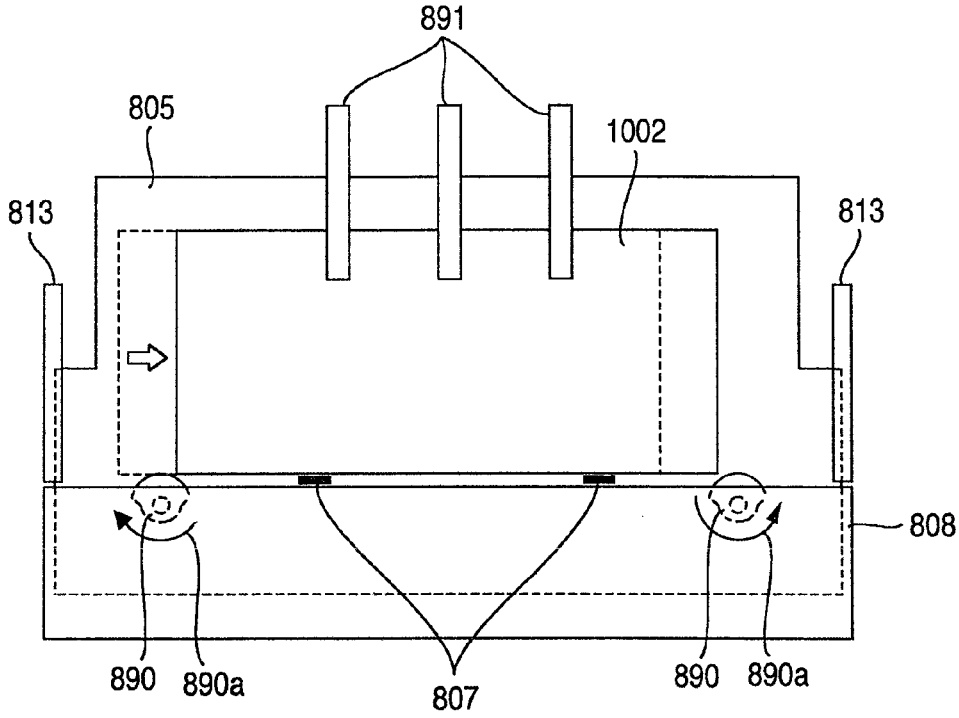
FIG. 10A
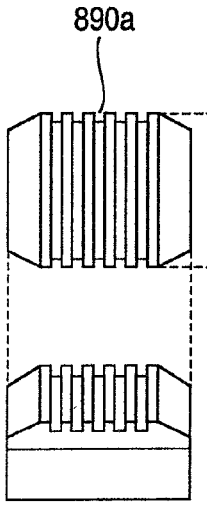
FIG. 10B
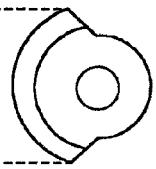
FIG. 10C
FIG. 10D
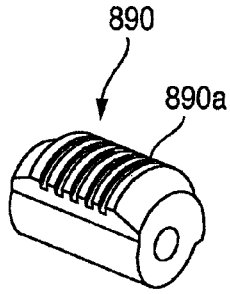
FIG. 10E
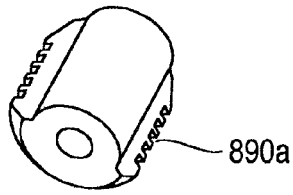

BANKNOTE HANDLING APPARATUS

BACKGROUND OF THE INVENTION (1) Field of the Invention

The present invention relates to a banknote handling apparatus for handling paper sheets.

(2) Description of Related Art

A banknote handling apparatus includes an internal conveying path and banknote accommodation spaces in internal devices, which possibly have widths different from one another, and accordingly, it is required to have a processing function capable of correcting a deviation of a bank note which has bee shifted sidewise, that is, which has been deviated. For example, JP-A-2000-16597 discloses a paper sheet supply apparatus as an apparatus for processing a deviation of a banknote when banknotes are stacked one upon another.

The above-mentioned paper sheet supply apparatus incorporates a vibration object adapted to be taken out and taken onto a floor surface of a space in which a paper sheet (which will be hereinbelow referred to as "banknote") is placed, for subjecting banknotes in a standing posture to vibration at their lower ends in order to align the postures of the banknotes. That is, the banknotes subjected to the vibration are moved with their one side being laid along one side surface under the influence of the gravitational force, thereby it is possible to arrange the postures of the banknotes in order.

SUMMARY OF THE INVENTION

As stated above, the banknote stacking apparatus disclosed in JP-A-2000-16597 is adapted to subject banknotes to vibration, and to utilize the gravitational force so as to line up the banknotes along one side surface. However, should the banknotes be line up along one side surface, the smaller the size of the banknotes, the larger the deviation thereof, the banknote could not be caught up by a conveying belt or the like, causing the deficiency that normal conveyance of banknotes cannot be materialized, and so forth.

An object of the present invention is to provide a banknote handling apparatus capable of processing a deviation of a banknote in a banknote storage bin so as to displace the banknote to an optional position.

(1) In order to achieve the above-mentioned object, according to the present invention, there is provided a paper sheet handling apparatus incorporating a paper sheet storage bin for storing therein paper sheets in a stack, characterized by a deviation processing means for displacing paper sheets to be taken into the storage space which is located at a mid position or paper sheets arranged in a condition in which the paper sheets are stored in the storage bin, in deviated directions of the paper sheets.

(2) In order to achieve the above-mentioned object, according to the present invention, there is provided a paper sheet handling apparatus comprising a floor surface for carrying thereon paper sheets, a pressing board for pressing the paper sheets in a stacking direction, and a paper sheet storage bin composed of a top panel and side walls, for storing the paper sheets in a stack, wherein a deviation processing means which is arranged on the floor surface displaces the paper sheets in directions of deviation of the paper sheets under a friction force when it makes into contact with the paper sheets to be taken into the storage bin, which are located at a mid position, or the paper sheets arranged in a condition in which is stored in the storage bin.

(3) In order to achieve the above-mentioned objects, according to the present invention, there is provided a paper sheet handling apparatus comprising a bottom surface belt provided so as to carry thereon paper sheets above a floor surface, a pressing board for pressing the paper sheets in a stacking direction, a temporary storage bin composed of a top panel and side panels, wherein deviation disposing means has apices projected from the floor surface belt and located on the left and right sides of the bottom surface belt, one for each side, the deviation processing means being rotated in their parts projected from the floor surface belt, toward the center of the apparatus, and the paper sheets stored in the temporary storage bin are displaced toward the center of the apparatus by the deviation processing means under a friction force when the paper sheets are located at a position where they make contact at their lower sides with the deviation processing means.

(4) In view of the above-mentioned item (2) or (3), the deviation processing means is preferably adapted to make contact with at least on side of the paper sheets stored in the paper sheet storage bin in a stack, and to apply a force to the paper sheets at least in the directions of deviation thereof.

(5) In view of the above-mentioned item (2) or (3), the deviation processing means is preferably adapted to fall into each of two conditions, that is, it makes contact with the paper sheets stored in the paper sheet storage and it does not make contact with them.

(6) In view of the above-mentioned item (2) or (3), preferably, a plurality of deviation processing means are incorporated in the paper sheet storage bin, and each deviation processing means apply force forces to the paper sheets in directions of deviation thereof, which are identical or different from one another.

(7) In view of the above-mentioned item (6), the distance between the plurality of deviation processing means is preferably longer than the deviationwise length of the paper sheets as objects to be displaced deviationwise.

(8) In view of the above-mentioned item (2) or (3), the deviation processing means is preferably located in the vicinity of a paper sheet introduction gate in the paper sheet storage bin.

(9) In view of the above-mentioned item (2) or (3), the deviation processing means is preferably incorporated with a paper sheet detecting means for detecting a kind, a condition or both of the paper sheets.

(10) In view of the above-mentioned item (9), the deviation processing means is preferably adapted to change the degree and the time of contact with the paper sheets, and the force applied to the paper sheets in accordance with a kind/condition of the paper sheets made into contact with the deviation processing means.

(11) In view of the above-mentioned item (2) or (3), the deviation processing means preferably has a portion which is made into contact with the paper sheets, which is formed of a high friction member.

(12) In view of the above-mentioned item (4), the deviation processing means preferably has a paper sheet contact portion adapted to make contact with the paper sheets, the paper sheet contact portion having an uneven outer surface, and the paper sheet contact surface makes contact at least with one side of the paper sheets and as well with surfaces therearound so as to apply a force at least in directions of deviation of the paper sheets.

(13) In view of the above-mentioned item (12), the paper sheet contact portion preferably has paper sheet contact surfaces which are substantially in parallel with the surfaces of paper sheets to be stored in the paper sheet storage bin in a stack.

(14) In view of the above-mentioned item (12), the paper sheet contact portion preferably has paper sheet catching surfaces which are substantially perpendicular to surfaces of the paper sheets to be stored in the paper sheet storage bin in a stack.

(15) In view of the above-mentioned item (13), there is provided a paper sheet pressing means for applying a force to the paper sheets in a direction in which the paper sheets in the paper sheet storage bin make contact with the paper sheet catching surface.

The above-mentioned object of the present invention is achieved by a paper sheet storage bin for stacking banknotes one upon another in order to store the banknotes in the paper sheet storage bin, the paper sheet storage bin incorporating a deviation processing means for displacing a banknote which is just taken into or has been stored in the storage bin, in a direction of deviation of the banknote.

Further, the above-mentioned objects can be achieved by a paper sheet handing apparatus comprising a bottom surface belt arranged to support a lower surface of banknotes on a surface which is above a floor surface, a press board for pressing the banknotes in a stacking direction, and a temporary storage bin comprising a top panel and side walls, the apparatus including deviation processing means having apexes which are projected from the bottom surface belt, and located on the floor surface, one for each of the left and right sides of the floor surface, wherein the deviation processing means rotates its parts projected from the bottom surface belt, in a direction toward the center of the apparatus, and banknotes stacked in the temporary storage bin are displaced in the direction toward the center of the temporary storage bin by frictional forces of the deviation processing means when the banknotes are located at a position where the banknotes make contact at their lower sides with the deviation processing means.

Further, the above-mentioned objects can be achieved by the deviation processing means which make contact with at least one side of the paper sheet having been stored and stacked in the paper sheet storage bin, so as to apply a force to the paper sheet, at least in a direction of deviation of the paper sheet.

Further, the above-mentioned objects can be achieved by the deviation processing means which falls either in a condition in which it makes contact with the banknotes stored in the paper sheet storage bin or in a condition in which it does not make contact therewith.

Further, the above-mentioned objects can be achieved by a plurality of deviation processing means incorporated in the paper sheet storage bin, having deviating directions in which the deviation processing means apply forces, and which are different from one another.

Further, the above-mentioned object can be achieved by the plurality of incorporated deviation processing means having distances therebetween which are longer than the length of a paper sheet to be displaced in the direction of deviation, in view of the direction of deviation.

Further, the above-mentioned object can be achieved by the deviation processing means which is located in the vicinity of a paper sheet intake port in the paper sheet storage bin.

The above-mentioned object can be achieved by the paper sheet handling apparatus characterized by the provision of a paper sheet detecting means for detecting a kind, a condition or both of a paper sheet.

The above-mentioned object can be achieved by the deviation processing means which changes a degree and a time of making contact with the paper sheets, and a direction of a force applied to the paper sheets in accordance with a kind and a condition of a paper sheet which makes contact with the deviation processing means.

The above-mentioned object can be achieved by the paper sheet handling apparatus incorporating a paper sheet pressing means for applying a force to paper sheets in a direction in which the paper sheets in the paper sheet handling apparatus is made into contact with the deviation processing means.

According to the present invention, there can be provided a banknote handling apparatus capable of processing banknotes in a banknote storage bin so as to displace a deviated banknote to an optional position.

The present invention can materialize a banknote handling apparatus capable of processing a deviation of a banknote stored in a banknote storage bin.

Other objects, features and advantages of the invention will become apparent from the following description of the embodiments of the invention taken in conjunction with the accompanying drawings.

BRIEF DESCRIPTION OF THE DRAWINGS

FIG. 9 is a front view for explaining a condition in which a deviation of a banknote in the temporary storage bin is processed, in the embodiment;

FIGS. 10A to 10E are trihedral views and perspective views illustrating the deviation processing means in the embodiment;

FIGS. 13A to 13D are views for illustrating a deviation processing means in a third example, constituting the banknote handling apparatus in the embodiment of the present invention, in which FIG. 13A is a plan view, FIG. 13B is a side view, FIG. 13C is a front view and FIG. 13D is a perspective view;

DETAILED DESCRIPTION OF THE INVENTION

At first, explanation will be made of a general automatic tailor machine.

[Embodiment 1 ]

Figure 1:
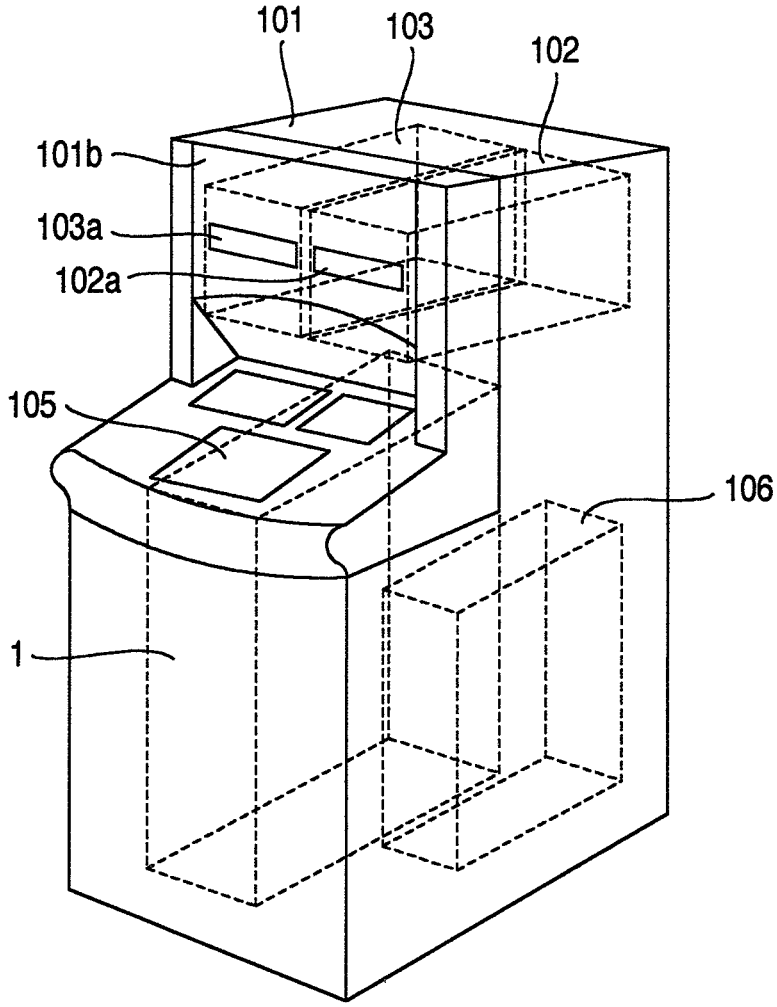
FIG. 1 is a perspective view illustrating an external appearance of an automatic tailor machine in one embodiment of the present invention.

Explanation will be made of a banknote handing apparatus in an embodiment of the present invention with reference to the accompanying drawings. FIG. 1 is a perspective view illustrating an external appearance of an automatic teller machine incorporating the banknote handling apparatus in an embodiment of the present invention. Referring to FIG. 1, the automatic teller machine incorporates, in the upper part of its housing 101, a card and list processing mechanism 102 communicated with a card slot 102*a* formed in a upper front panel 101*b* of the housing 101, for processing a card belonging to the user so as to print and discharge a transaction list, and a bankbook proceeding mechanism 103 communicated with a bankbook slot 103*a* for processing a bankbook belonging to the user.

Referring to FIG. 1, a housing 101 constituting an outline of an apparatus body is incorporated in its upper part with a a card and list processing mechanism 102 communicated with a card slot 102*a* formed in an upper front panel 101*b*, for processing a card belonging to the user, and printing a list and discharging the same, and a bankbook processing mechanism communicated with a bankbook slot 103, for processing a bankbook belonging to the user.

Further, the housing 101 incorporates, in its lower part, a banknote handling apparatus 1, and is provided in its middle part with a customer manipulating portion 105 for displaying and inputting a content of transactions. Further, there is shown a body control portion 106 for managing the control for the overall automatic tailor machine.

Figure 2:
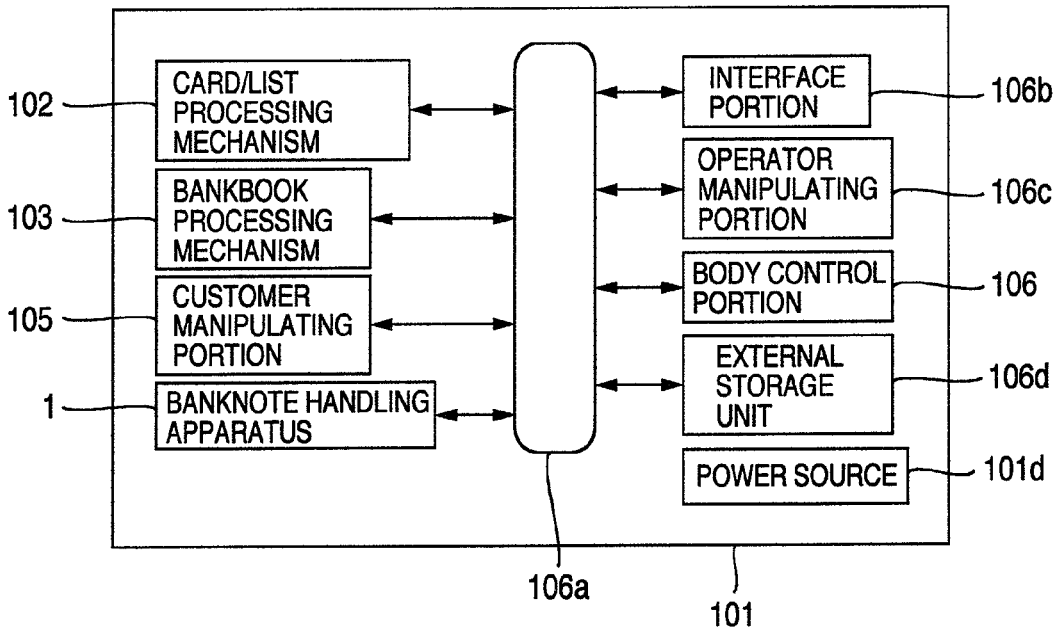
FIG. 2 is a block diagram for explaining a control relationship of the automatic tailor machine in the embodiment.

FIG. 2 is a block diagram for explaining a control relationship in the automatic tailor machine.

Referring to FIG. 2, the card/list processing mechanism 102, the bankbook processing mechanism 103, the banknote handling apparatus 1 and the customer manipulating portion 105 which are provided in the body housing 101, are connected to the body control portion 106 by way of a bus 106*a*, and are adapted to carry out necessary operation under the control of the body control portion 106. In addition to the above-mentioned components, the body control portion 106 is also connected thereto with an interface portion 106*b*, an operator manipulating portion 106*c* and an external storage unit 106*d* by way of the bus 106*a* so as to transmit and receive required data to and from one another. Further, there is shown in FIG. 2, an electric power source portion 101*d* for feeding an electric power to the above-mentioned mechanisms and components.

Figure 3:
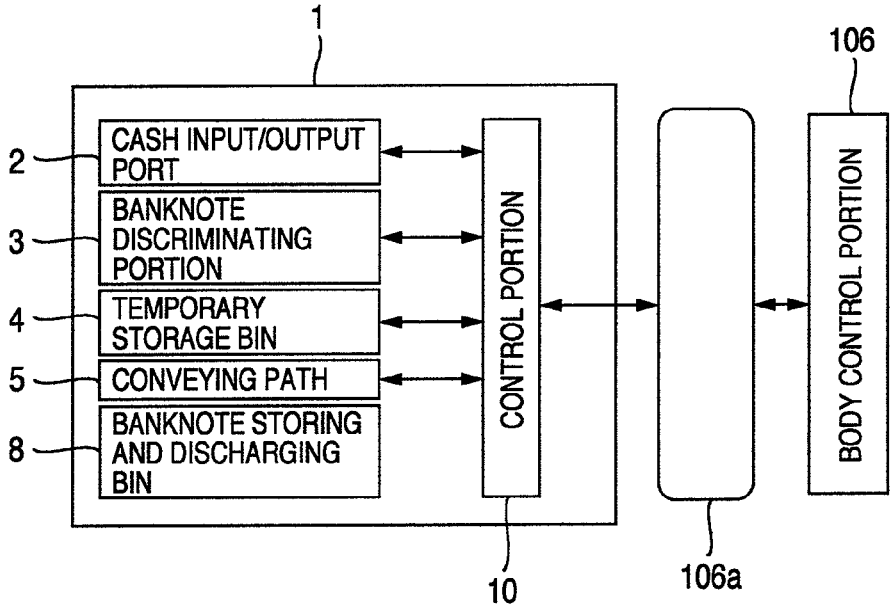
FIG. 3 is a block diagram for explaining a control relationship of a banknote handing apparatus in the embodiment.

FIG. 3 is a block diagram for explaining the control relationship of the banknote handling apparatus.

Referring to FIG. 3, the control portion 10 is connected to the body control portion 106 in the apparatus by way of a bus 106*a*, and controls the banknote handling apparatus 1 in response to an instruction delivered from the body control portion 101 in accordance with a detected condition of the banknote handling apparatus 1. Further, it transmits a condition of the banknote handling apparatus 1 to the body control portion 106 as necessary.

Figure 4:
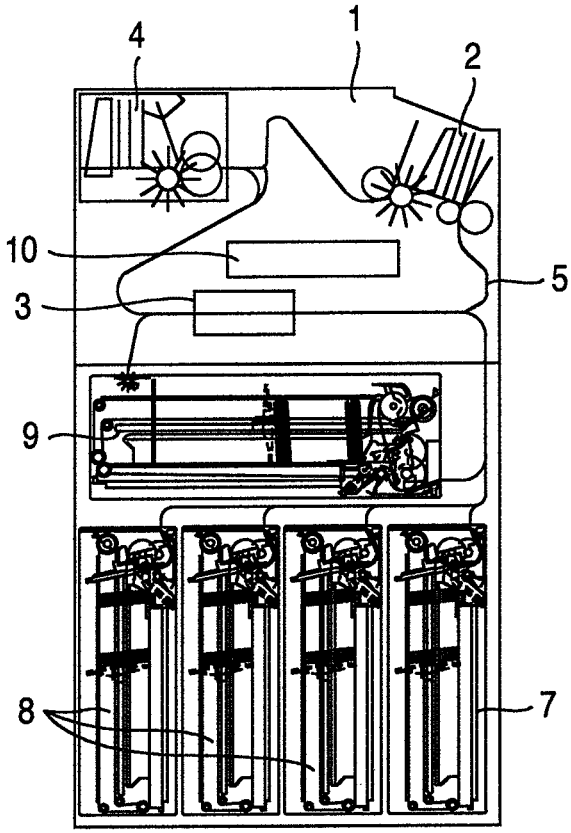
FIG. 4 is a side view illustrating the banknote handling apparatus in the embodiment.

FIG. 4 is a side sectional view which shows the configuration of the banknote handling apparatus.

Referring to FIG. 4, the banknote handling apparatus 1 is mainly composed of a cash input/output port 2, a banknote discriminating portion 3 for discriminating a banknote, a temporary storage bin 4 for once storing inputted banknotes therein until transactions has be completed, a banknote storage bin 7 for storing only banknotes to be handled by the banknote handling apparatus 1, banknote storing and discharging bins 8 for storing and discharging banknotes to be handled by the banknote handling apparatus, a loading and unloading bin 9 for unloading banknotes stored in cash boxes in the banknote handling apparatus, loading banknotes into the cash boxes in the banknote handling apparatus and so forth, and a conveying path 5.

It is noted that the banknote storage bin 7 serves as a cash box for storing therein inputted banknotes, unusable banknotes, banknotes left by the user or the like. Further, the components in the above-mentioned banknote handling apparatus 1 may be selectively incorporated, depending upon the use purpose thereof.

Next, explanation will be made of the operation of the banknote handling apparatus 1. During receiving transactions, banknotes charged in the cash input/output port 2, are separated from one another one by one, and after determination of a denomination and the truth or the falsehood in the banknote discriminating portion 3, they are once stored in the temporary storage bin 4. At this time, banknotes which cannot be discriminated in the banknote discriminating portion 3, banknotes which are abnormally inclined or abnormally spaced from each other, are directly conveyed into the cash input/output port 2 for pay-back to the user. After the receiving transactions are completed, the banknotes are delivered from the temporary storage bin 4, and after confirmation of conditions of the banknotes in the banknote discriminating portion 3, the banknotes are stored in the banknote storage bin 7, the banknote storing and discharging bins 8 or the like.

Upon payment, banknotes to be delivered are paid out by a predetermined number from the corresponding one of the banknote storing and discharging bins 8, are then discriminated in the banknote discriminating portion 3, and are then conveyed into the cash input/output port 2 from which the banknotes are paid to the user. During the payment operation, if an unusable banknote is found, the unusable banknote is once stored in the temporary storage bin 4, and a banknote instead thereof is additionally paid out from the banknote storing and discharging bin 8. Thereafter, the unusable banknote is paid out from the temporary storage bin 4, and is conveyed and stored into the banknote storage bin 7 or the like.

Figure 5:
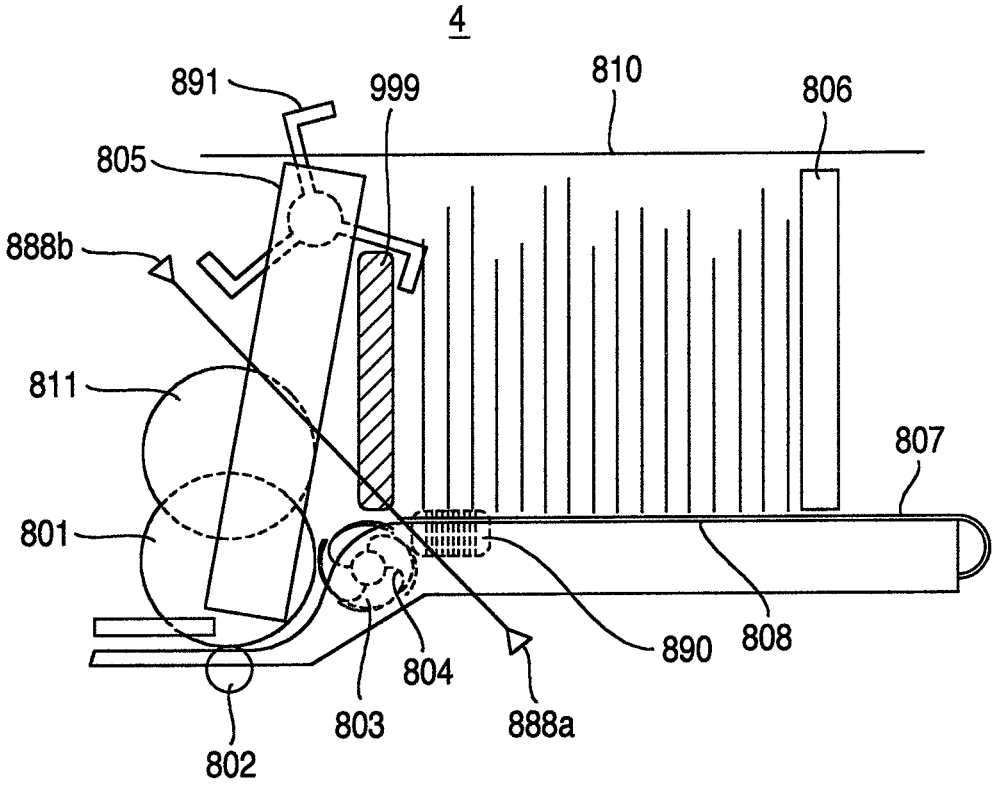
FIG. 5 is a side view for explaining a condition in which a banknote is stored in a temporary storage bin in the embodiment.

FIG. 5 is a side view for explaining the condition that banknotes are stored in the temporary storage bin 4 incorporating the embodiment of the present invention.

Figure 6:
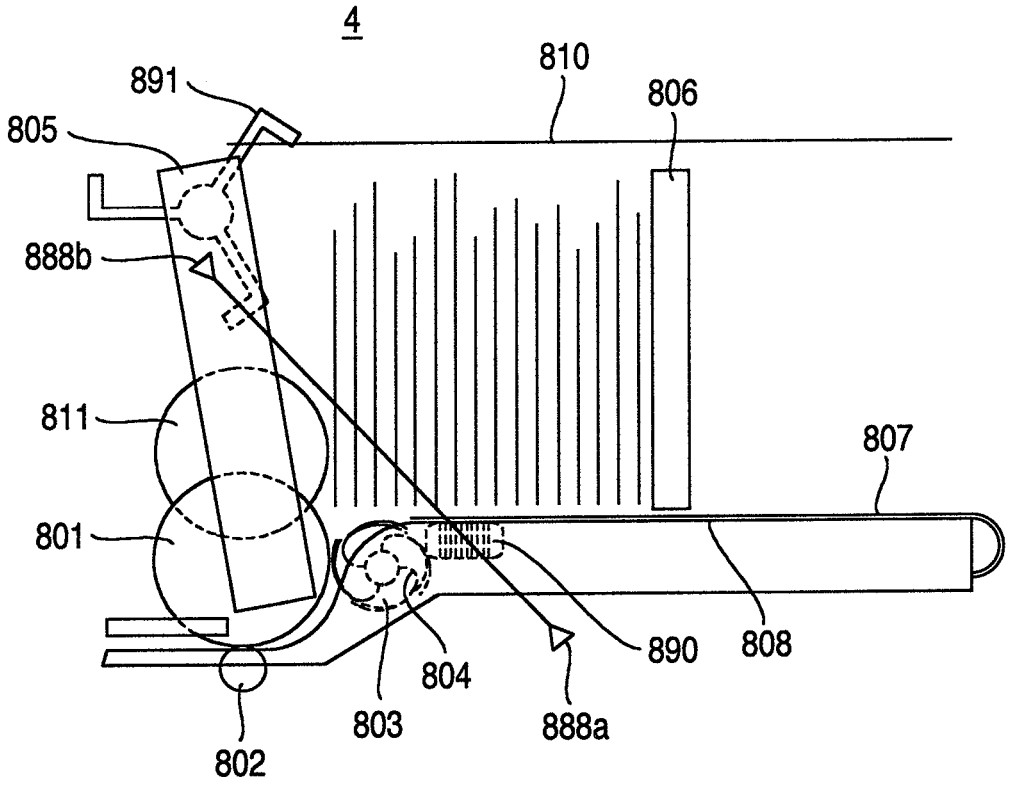
FIG. 6 is a side view for explaining a condition in which a banknote is discharged from the temporary storage bin 4 in the embodiment.

FIG. 6 is a side view for explaining the condition that the banknote are discharged from the temporary storage bin 4 incorporating the embodiment of the present invention.

Referring to FIGS. 5 and 6, the above-mentioned temporary storage bin 4 has a mechanism for stacking or separating banknotes in a standing posture. A banknote introduction/delivery mechanism comprises an introduction/delivery gate which is composed of a feed roller 801, a pickup roller 811, a driven backup roller 802, a gate roller 803 adapted to be rotated in a banknote storing direction but to be not rotated in a payout direction, a brush roller 804 arranged coaxial with the gate roller 803 and having flexible push-in members radially extended, a separating and stacking guide 805 for guiding a banknote, and transmission sensors (residual banknote sensors) 888*a*, 888*b*. Further, the temporary storage bin 4 is composed of a floor surface 808, a bottom surface belt 807 laid above the floor surface 808 and suspended so as to support the lower surface of the banknotes on a surface above the floor surface 808, a press board 806, a top panel 810 and side walls 813 (which will be detailed later with reference to FIG. 9). A deviation processing means 890 (which will be detailed later) is mounted on the upstream side of the bottom surface belt 807.

The feed roller 801 is rotated being driven by means of a drive source (which is not shown) and a gear so as to feed a banknote to be stored into a stacking space 999 or to feed a banknote to be discharged to the conveying path 5. The backup roller 802 is rotated being driven by the feed roller 801, and pinches a banknote between itself and the feed roller 801 so as to feed the banknote. The gate roller 803 is rotated being driven by the feed roller 811 during introduction of a banknote but is not rotated during pay-out of a banknote. With this configuration, when a banknote is separated and paid out by the pickup roller 811 and the feed roller 801, a banknote adjacent to the banknote to be paid out is subjected to a frictional resistance by the gate roller 803, and accordingly is prevented from being paid-out following the banknote to be paid out.

The feed roller 801 and the gate roller 802 serve as the introduction/delivery gate next to the stacking space 999. That is, when an externally introduced banknote is released from the pinch between the feed roller 801 and the gate roller 803, the banknote comes under unconstraint, except making contact with the separating and stacking guide 805, and is then introduced into the stacking space 999. The separating and stacking guide 805 have a side surface on the stacking space 999 side, which serves as a banknote guide surface and which therefore guides the banknote during storing or discharging thereof. During storing of a banknote, the banknote guide surface is located at a position where it is laid along an extension of the introduction/delivery gate of the introduction/delivery mechanism in the banknote advancing direction. During discharging of a banknote, the banknote guide surface is retracted to a position where the pickup roller 811 is exposed.

The side walls 813 (which will be detailed later with reference to FIG. 9) can be set with respect to its attachment position, depending upon a size of a banknote. The width of the side wall 813 is suitably set to a value which is larger than the widthwise size of a largest banknote by about 2 to 10 mm. Further, the distance between the floor surface 808 and the top panel 810 is set to a value which is longer than the heightwise length of the maximum banknote.

This embodiment incorporates an advance regulating means 891 above the separating and stacking guide 805. The advance regulating means 891 has a role of regulating a banknote so as to restrain the banknote from excessively advancing upward when the banknote is stacked in the stacking space 999. The advance regulating means 891 in this embodiment has three blade-like members, and accordingly, it defines therein three recesses. It is noted that the number of the blade-like members may be arbitrary, different from the number as shown. Further, with the provision of a plurality of advance regulating means 891 in the widthwise direction of a banknote, the upper end part of the banknote may be regulated at a plurality of positions.

Next, explanation will be made of the operation of the temporary storage bin 4 in the case of storing banknotes having different sizes in combination.

The process of stacking banknotes will be hereinbelow explained with reference to FIGS. 7 and 8.

Figure 7:
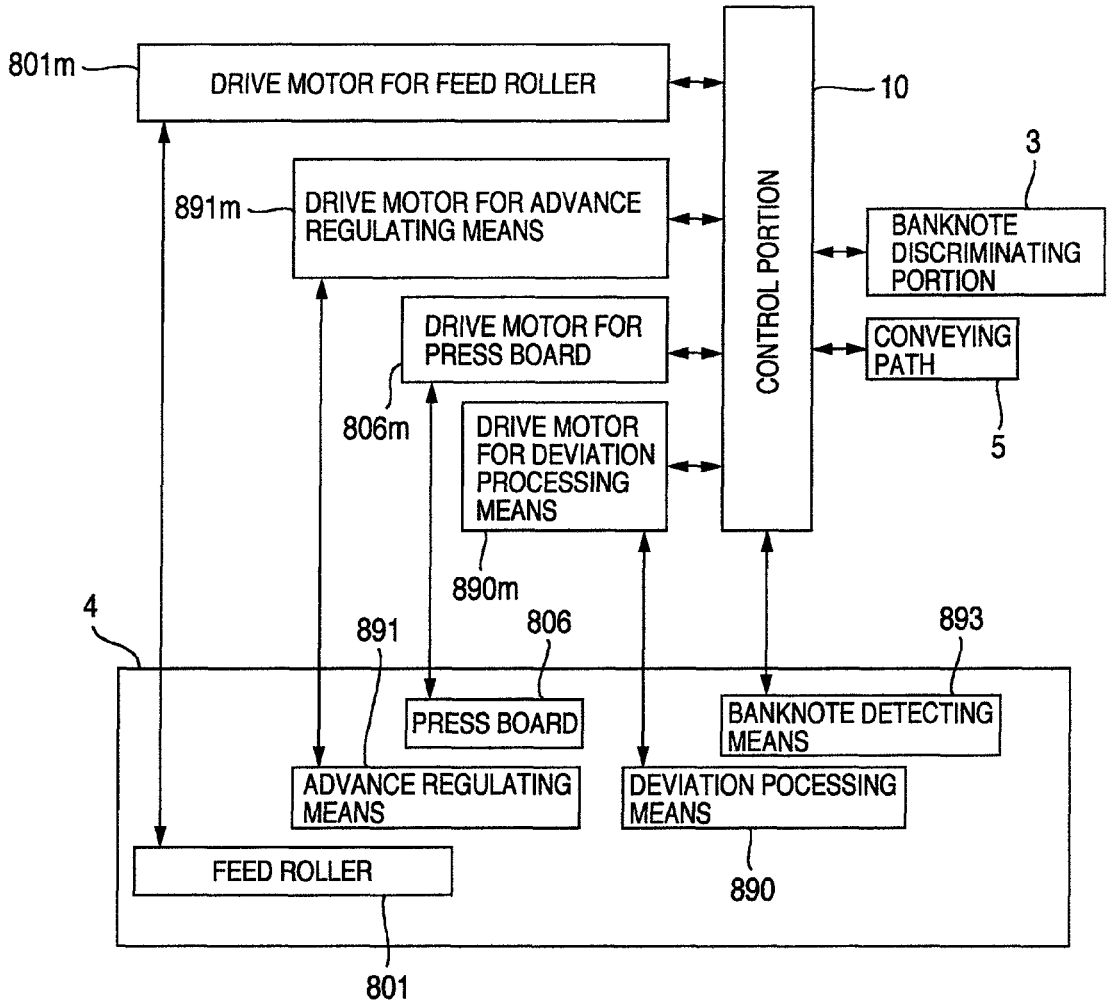
FIG. 7 is a block diagram for explaining a control relationship among components in the temporary storage bin in the embodiment.

FIG. 7 is a block diagram for explaining a control relationship of several components of the temporary storage bin 4.

Figure 8:
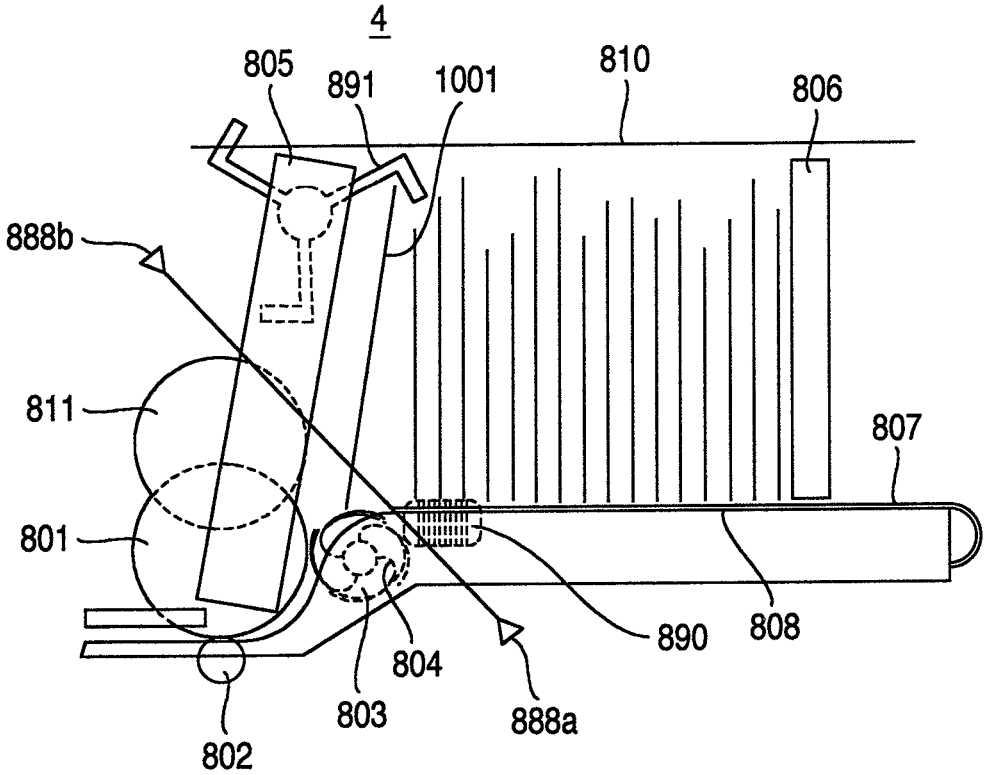
FIG. 8 is a side view for explaining a condition in which a banknote is stored in the temporary storage bin in the embodiment.

FIG. 8 is a side view for explaining a condition of storing a banknote in the temporary storage bin.

Referring to FIGS. 7 and 8, the feed roller 801 and the gate roller 803 are rotated so as to feed a banknote 1001 to be stacked, which has passed through the banknote discriminating portion 3, into the stacking space 999. At this time, the banknote 1001 to be stacked is conveyed along the banknote guide surface of the separating and stacking guide 805 with its standing posture being maintained.

The banknote introduced into the temporary storage bin 4, and having been released from the pinching force between the feed roller 801 and the gate roller 803 is raked out from the pinching position between the feed roller 801 and the gate roller 803 by means of the brush roller 804 on rotation for preventing the banknote from bumping upon the following banknote. It is noted that the brush roller 804 which are rotated at a high speed also prevents a banknote raked out from the pinching position between the feed roller 801 and the gate roller 803 or the lower end of a banknote which has been already introduced into the temporary storage bin 4, from approaching the feed roller 801 and the gate roller 803.

During the introduction of the banknote into the stacking space 999, the control portion 10 rotates under control the advance regulating means 891 in a clockwise direction as viewed in FIG. 8, in accordance with data of the banknote 1001 obtained by the banknote discriminating portion 3, in order to set the distance from the floor surface 808 to one of the recesses of the advance regulating means 891, so as to be equal to the length of the banknote 1001 in the advancing direction.

It is noted that FIG. 8 shows the stacking of banknotes having a relatively large size while FIG. 6 shows the stacking of banknotes having a relatively small size.

The banknote 1001 having stacked in the stacking space 999 and released from the pinch between the feed roller 801 and the gate roller 803 impinges upon the recess of the advance regulating means 891, and is therefore stopped. On this stage, the distance from the floor surface 808 to the recess of the advance regulating means 891 is equal to the length of the banknote 1001 to be stacked, in the advancing direction thereof, and accordingly, the banknote 1001 to be stacked can be stored with its rear end part being arranged in order on the floor surface 808, without being excessively advanced.

The above-mentioned operation is carried out successively, that is, when a banknote detecting means 893 which is not shown in this figure detects a banknote fed into the temporary storage bin 4, the advance regulating means 891 is rotated in dependence upon a size of the banknote, thereby it is possible to successively stack banknotes having different sizes in the temporary storage bin 4.

The light beam between the transmission sensors 888*a*, 888*b* is blocked by an introduced banknote, and since the brush roller 804 can retain introduced banknotes as far as the number of the introduced banknotes is less, the blocking time is short. However, after the introduction of banknotes is continued, the brush roller 804 can not retain the banknote anymore, and accordingly, the blocking time becomes longer. If the blocking time becomes longer than a predetermined time, the press board 806 and the bottom surface belt 807 are moved together in a direction away from the separating and stacking guide 805 by a drive source which is provided outside of the storage bin and which is not shown, and accordingly, the banknotes which have been already stored can be moved in the direction away from the separating and stacking guide 805. As a result, the number of banknotes which occupy a place around the stacking space 999 becomes less, and accordingly, the brush roller 804 can again retain banknotes.

Next, the operation in the case of discharging a banknote from the temporary storage bin 4 will be explained. When a banknote is discharged from the temporary storage bin 4, as shown in FIG. 6, the advance regulating means 891 is at first rotated up to a position where it does not interfere with a banknote, and is then fixed. Thereafter, the press board 806 is displaced toward the separating and stacking guide 905 in order to press stored banknote against the separating and stacking guide 805. On this stage, the pickup roller 811 is exposed, and accordingly, the pickup roller 811 can make contact with the banknotes. Further, when the pickup roller 811 is rotated, the stored banknotes are discharged out from the temporary storage bin 4, being separated one by one. It is noted on this stage that the brush roller 804 rotated with its sheets being rounded so as to prevent the separation of the banknotes from being hindered. Further, the press board 806 and the bottom surface belt 807 are continuously moved under the control that they apply a predetermined pressing force to the pickup roller 811.

In the operation as stated above, the control portion 10 shown in FIG. 4 manages the operation for the drive portions, the sensors and the like in the temporary storage bin 4. Further, a banknote size detecting means composed of the banknote discriminating portion 3 for discriminating a denomination of a banknote, and a storage portion DB having a data base for assigning a denomination to a size of a banknote recognizes a size of a banknote passing through the banknote discriminating portion 3, and transmits at once the thus obtained data to the control portion 10. On this stage, data concerning an arranged number of a banknote in the conveying sequence order is also transmitted to the control portion 10.

It is noted in this embodiment that the rotary shaft of the advance regulating means 891 is journalled to the separating and stacking guide 805, and accordingly, the advance regulating means 891 can be retracted together with the separating and stacking guide 805. However, the separating and stacking guide 805 and the advance regulating means 891 may be displaced, independent from each other.

With the provision of the temporary storage bin 4 as stated above, there may be materialized an automatic tailor machine capable of handing various banknotes having different sizes.

Next, explanation will be made of a deviation process for the banknotes, having an essential features of the present invention. The temporary storage bin 4 has side walls 813 with a width which is a size corresponding to a size of a maximum banknote to be handled since all banknotes received into the banknote handling apparatus 1 should be stored in the temporary banknote storage bin 4. Meanwhile, the distance between the side walls of, for example, in one of the banknote storing and discharging bins 8 is set to a value adjusted to a size of banknotes as an object to be handled in this banknote storing and discharging bin 8 since a kind of banknotes to be stored in every banknote storing and discharging bin 8 is fixed. Accordingly, the difference between the distance between the side walls of the banknote storing and discharging bin 8 for storing banknotes as an object to be stored having a small size and the distance between the side walls of the temporary storage bin 4 would be relatively larger. In view of this fact, there would be caused the case that a banknote discharged from the temporary storage bin 4 is conveyed to the banknote storing and discharging bin 8, being largely deviated transversely to the conveying direction thereof so as to exceed the distance between the side walls of the banknote storing and discharging bin 8, and as a result, the banknote cannot be appropriately taken into the banknote storing and discharging bin 8, thereby it is necessary to displace a banknote introduced in the temporary storage bin 4, transversely to the conveying direction (for carrying out a deviation process).

Thus, since the general automatic tailor machine has the conveying path therein and the banknote storage spaces in the internal devices, which possibly have different widths, requires a means for correcting a deviation of a banknote which has been sidewise shifted with respect to the conveying direction, that is, which has been deviated.

Accordingly, the inventors in the present application studied diversely, and have devised the following embodiment which will be explained hereinbelow.

[Embodiment 2 ]

FIG. 9 is a front view for explaining a condition of processing a deviation of a banknote in a temporary storage bin in this embodiment.

By the way, since it is required to introduce all banknotes received in the banknote handling apparatus 1, into the temporary storage bin 4, the width of the side walls 812 is set to a size which corresponds to a maximum size of a banknote to be handled. Meanwhile, for example, the distance between the side walls of each of the banknote storing and discharging bins 8 is set to a value corresponding to a size of a banknote to be stored therein since the size of the banknotes stored in this banknote storing and discharging bin 8 is fixed. Thus, there is possibly caused a large difference between the distance between the side walls of the banknote storing and discharging bin 8 for banknotes to be stored which have a small size, and distance between the side walls of the temporary storage bin 4. In this case, a banknote discharged from the temporary storage bin 4 would be conveyed to the banknote storing and discharging bin 8, being largely shifted crosswise of the conveying direction by a value which is larger than the distance between the side walls of the banknote storing and discharging bin 8, and accordingly, the banknote cannot be appropriately received into the banknote storing the discharging bin 8. Thus, it is necessary to shift the banknote taken into the temporary storage bin 4 crosswise to the conveying direction (a deviation is processed).

Referring to FIG. 9, explanation will be made of the deviation processing means 890 serving as a mechanism for processing a deviation of the banknote. The deviation processing means 890 having apexes are mounted, each for each of the left and right sides of the floor surface 808, so that the apexes are projected from the bottom surface belt 807 by few millimeters (about 2 to 4 mm). In this deviation processing means 890, the parts projected from the bottom surface belt 809 are rotated in the direction toward the center of the apparatus, as indicated by the arrow 890*a*. In the case that banknotes 1002 stacked in the temporary storage bin 4 are located at a position where the lower side of the banknotes 1002 make contact with the deviation processing means 890 (that is, it is located been deviated from the center in the temporary storage bin 4)on the bottom surface belt), it is displaced toward the center of the temporary storage bin 4 by a frictional force of the deviation processing means 890. Further, it can be said that an exciting force applied to the banknotes 1002 contributes to the displacement of the banknotes since the deviation processing means 890 is rotated so as to successively change over from a state in which it makes contact with the banknotes into a state in which it does not make contact with the banknotes, and vise versa. In view of these effects, the banknotes in the temporary storage bin 4 can be positioned at the center of the banknote accommodation space as shown in FIG. 11*a* which will be explained later.

Referring to FIG. 9 which shows the condition at the moment that the deviation processing means 890 is projected from the bottom surface belt 807, during the rotation, there could be the phase with which the deviation processing means 890 does not make contact with the banknotes 1002. In the case of discharging a banknote out from the temporary storage bin 4, the deviation processing means 890 is fixed in the phase that the deviation processing means 890 is hidden from the floor surface 808 so as to prevent the deviation processing means 890 from making contact with the banknotes 1002. Thus, the banknotes can be displaced without being caught to the deviation processing means 890.

Further, the deviation processing means 890 is driven under control by a drive motor 890*m* for the deviation processing means controlled by the control portion 10, as shown in FIG. 7, similar to the drive portions in the temporary storage bin 4.

It is noted that the deviation processing means 890 either may be continuously rotated unconditionally or may be rotated being driven only when a banknote to be corrected for a deviation is taken into the temporary storage bin 4. Further, all deviation processing means 890 either may be operated in synchronization with one other or may be rotated, independent from one another. Further, the degree of rotation of the deviation processing means 890 is appropriate about 1 to 3 revolutions, for each of banknotes taken into the temporary storage bin 4. However, it may be set to another value. The speed and degree of operation of the deviation processing means 890 may be changed in accordance with a kind or a condition of a banknote. In the case of changeover between the operation modes of the deviation processing means 890 in dependence upon a condition of a banknote to be taken into, data from the banknote discriminating portion 3 may be used for the kind or condition of the banknote, and data from another means for acquiring data concerning a size and a condition of the banknote and the like may be also used. Thus, the deviation processing means can process only a banknote for which a deviation is processed, that is, the other banknotes in the temporary storage bin 4 are never processed for deviations.

The two deviation processing means 890 are mounted in this embodiment, and in this case, it is desirable to set the distance between both means to a value which is larger than the longitudinal size of a banknote to be displaced to the center. Further, the deviation processing means 890 is preferably set at a place in the vicinity of the brush roller 804, where a banknote having been taken into the staking space in the temporary storage bin 4 lands at first, or a place on the press board 806 side as viewed from the brush roller 804. Moreover, it is preferably located in the vicinity of the brush roller 804 or at a position on the pressing board 8 side as viewed from the brush roller 804. It is noted that the number of the deviation processing means 890 may be also one or not less than 3.

Next, detailed explanation will be made of the deviation processing means 890 constituting the banknote handing apparatus in the embodiment of the present invention with reference to FIGS. 10A to 14.

Figure 11:
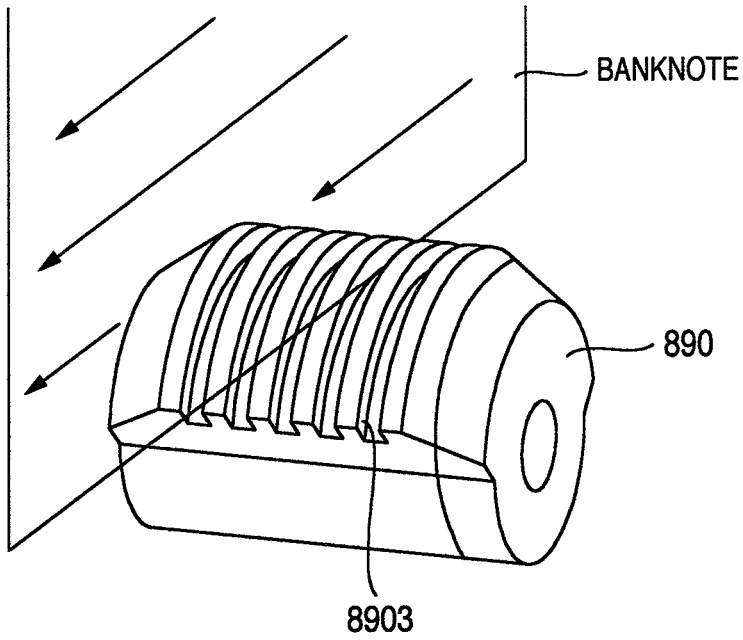
FIG. 11 is a perspective view for explaining a deviation processing means in a first embodiment, which constitutes the banknote handing apparatus in the embodiment of the present invention and which makes into contact with the banknotes.
Figure 12:
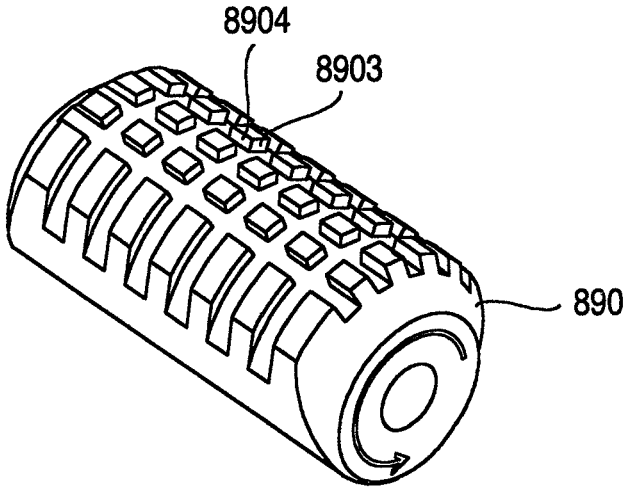
FIG. 12 is a perspective view illustrating a deviation processing means in a second example, which constitutes the banknote handling apparatus in the embodiment of the present invention.
Figure 13A:
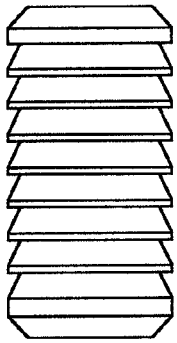
Figure 13C:
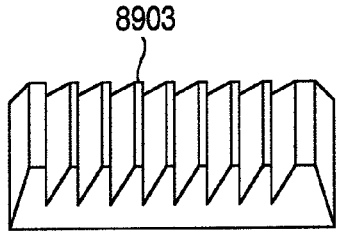
Figure 13B:
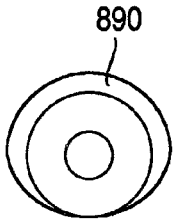
Figure 13D:
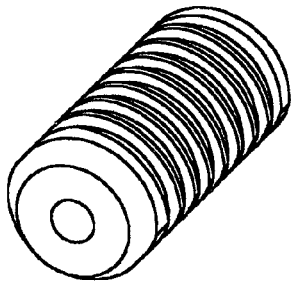
Figure 14:
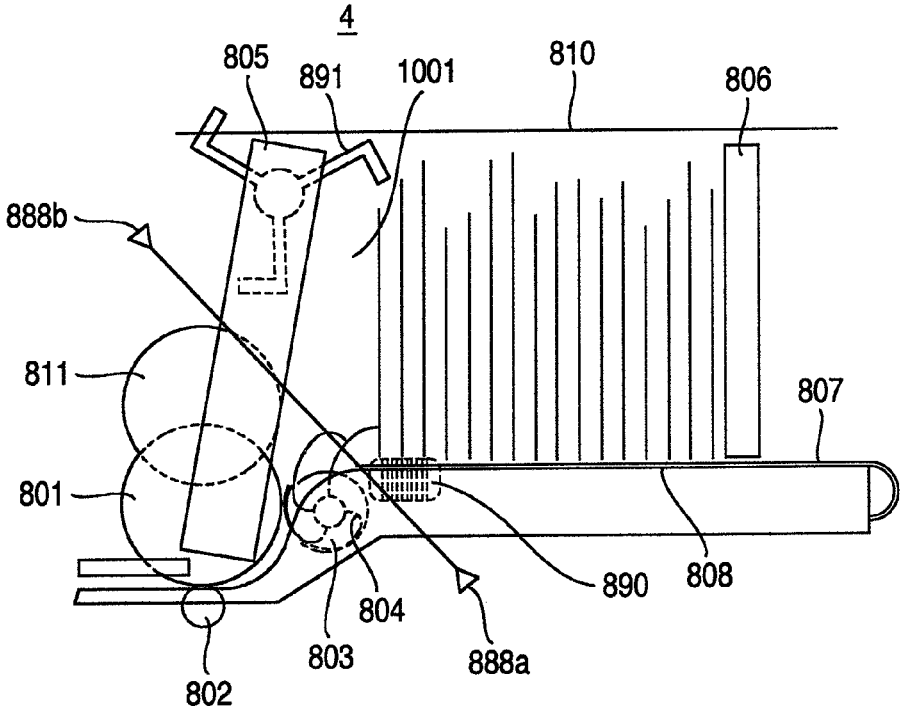
FIG. 14 is a side view illustrating a brush roller and a deviation processing means in a condition in which banknotes are stored in a temporary storage bin constituting the banknote handling apparatus in the embodiment of the present invention.
Figure 15A:
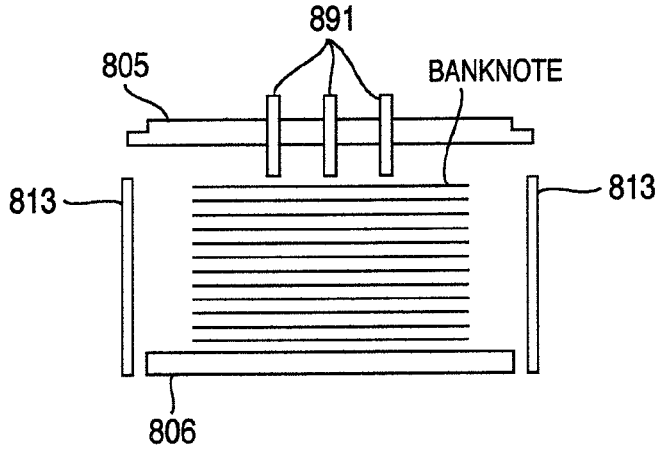
FIGS. 15A, 15B and 15C are top views for explaining a condition in which a deviation of a banknote in the temporary storage bin has been processed, in the embodiment.
Figure 15B:
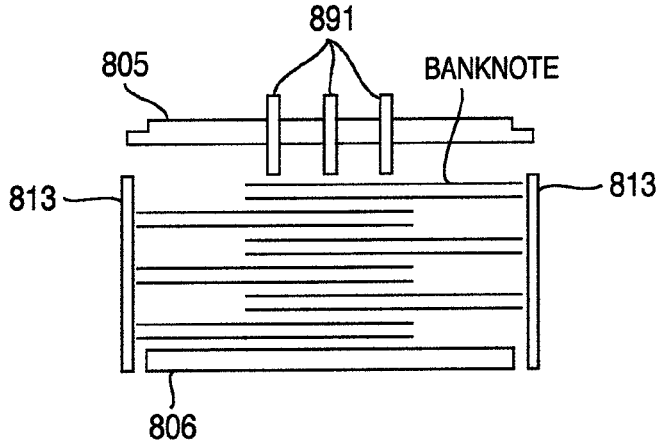
Figure 15C:
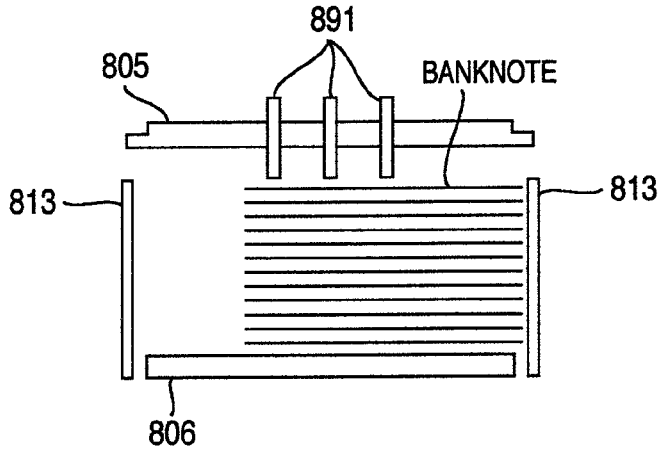

FIGS. 10A to 10E show a first example of the deviation processing means constituting the banknote handling apparatus in the embodiment of the present invention, in which FIG. 10A is a plan view, FIG. 10B is a side view, FIG. 10C is a front view, and FIG. 10D and FIG. 10E are perspective views. FIG. 11 is a perspective view for explaining the contact between the deviation processing means in the first example, and banknotes, and FIG. 12 is a perspective view illustrating a second example of a deviation processing means constituting the banknote handling apparatus in the embodiment of the present invention. Further, FIGS. 13A to 13D show a third example of a deviation processing means constituting the banknote handling apparatus in the embodiment of the present invention, in which FIG. 13A is a plan view, FIG. 13A is a side view, FIG. 13C is a front view, and FIG. 13D is a perspective view. Moreover, FIG. 14 is a side view illustrating the brush roller and the deviation processing means in a condition in which a banknote is stored in the temporary storage bin constituting the banknote handling apparatus in the embodiment of the present invention.

Referring to FIGS. 10A, 10B and 10C, the deviation processing means 890 is provided with a plurality of grooves 890*a* in the rotating direction, having a sectional shape, orthogonal to the axis, which is circular ark-like only in a part thereof. The number of these deviation processing means 890 may be only one, or not less than three. The deviation processing means 890 is preferably made of a material having a high frictional coefficient. The surface of the deviation processing means 890 which make contact with a banknote may be smooth with no concavities and convexities or may have grooves in the rotating or axial direction.

The deviation processing means 890 in this embodiment has a circular ark-like shape only in a part thereof so that the part of the sectional shape orthogonal to the axis is adapted to make contact with a banknote but the other part does not make contact with the banknote. However, it may be elliptic, may have a perimeter which is continuous or which depicts a discontinuously step-like line. Further, it may be a complete circular shape or the like near to the circular shape which can make contact with a banknote. Further, of the sectional shape including the axis, a part which makes contact with the lower side of a banknote may be of a straight line in parallel with the floor surface 808 or may be a slant line, a drum-like curve or other any curve.

Referring to FIG. 11 which shows the condition that banknotes are fitted in a plurality of grooves 890 formed in the outer surface of the deviation processing means 890 in the first example, side surfaces of each of the grooves 8903 serve as paper sheet contact surfaces 8903 since they are made into surface contact with surfaces in the vicinity of the end sides of the banknotes, and accordingly, by making the banknote contact surfaces 8903 into surface contact with the banknotes, a larger force for displacing the banknotes in a direction of deviation can be applied to the banknotes by the deviation processing means 890. That is, as shown in FIG. 11, the banknotes are fitted in the grooves 890*a* of the deviation processing means 890, and the surfaces of the banknotes fitted in the grooves are made into surface contact with the banknote contact surfaces 8903. As a result, in association with the rotation of the deviation processing means 890, the banknotes can be easily displaced in the directions of deviation (the direction of the arrow).

Referring to FIG. 12 which shows the deviation processing means 890 in the second example, incorporating grid-like grooves formed in the outer surface thereof. Specifically, in addition to the grooves in the rotating direction which are formed in the outer surface of the deviation processing means 890 in the first example, there are provided a plurality of grooves in the axial direction, having U-like cross-section. In this deviation processing means 890, the side surfaces respectively belonging to the above-mentioned grooves in the two directions define the banknote contact surfaces 8903, and as well define the banknote catching surfaces 8904 perpendicular to the banknote contact surface 8903. With the configuration of the deviation processing means 890 in the second example, in addition to the technical effects obtained by the deviation processing means 890 in the first example as stated above, there may be exhibited the technical effect that a banknote can be pushed out while a corner of a banknote is caught by the paper sheet catching surface 8904 in the direction of deviation thereof.

Referring to FIG. 13 which shows the deviation processing means 890 in the third example, formed in its outer surface with saw tooth-like grooves. Specifically, the grooves formed, in the rotating direction thereof, in the outer surface of the deviation processing means 890 have not a U-like cross-sectional shape but has a V-like cross-sectional shape, having one side surface perpendicular to the axis thereof, which services as the banknote contact surface 8903. With the configuration of the deviation processing means 890 in the third example, in addition to the technical effects obtained by the deviation processing means 890 in the first example as stated above, there can exhibited the technical effect that a banknote is restrained from being caught at its lower end when the banknotes are stacked in the accommodation space even though the paper sheet contact surfaces 8903 are incorporated, that is, the resistance which is exerted to a banknote by the deviation processing means when the banknote is displaced in the storing direction, can be reduced.

Referring to FIG. 14 which is a side view illustrating the brush roller 804 and the deviation processing means 890 in a condition in which the banknotes are stored in the temporary storage bin 54 constituting the banknote handling apparatus 1 in the embodiment of the present invention, in the case that the deviation processing means 890 incorporates the paper sheet contact surfaces 8903, the brush roller 804 on rotation has a role of a paper sheet pressing means for pressing the banknotes against the paper sheet contact surface 8903 in the case that the deviation processing means 890 incorporates the paper sheet contact surfaces 8903. That is, as shown in FIG. 14, the surfaces of the banknotes in the vicinity of their side ends are pressed against the paper sheet contact surfaces 8903 by the brush roller 804 on rotation. As a result, the deviation processing means 890 can apply a larger force to the banknotes, for displacing the banknotes in the direction of deviation thereof.

The deviation processing means 890 is the mechanism having a part which make contact with a banknote and which is rotated around the rotating axis as a center, but may be a mechanism having a part which makes contact with a banknote and which carries out unrotational motion or reciprocating motion with the use of a linkage, or which may be a mechanism applying vibration.

The degree of projection of the deviation processing means 890 from the bottom surface belt 807 may be a value out of the range from 2 to 4 mm. If no member corresponding to the bottom surface belt 807 is present, it may be projected from a member such as the floor surface with which the lower side of the banknote makes contact.

The destination bound for the conveyance of the banknote for which the deviation thereof has been processed in the temporary storage bin 4 may be the cash input/output port 2 or the temporary storage bin 4 itself, in addition to the banknote storing and discharging bin 8 and the banknote storage bin 7. That is, the deviation processing means 890 may be used when a banknote for payment is conveyed to the cash input/output port 2 or when a banknote discharged from the temporary storage bin 4 is reprocessed. Further, a banknote may be processed for its deviation by way of the temporary storage bin 4 incorporating the deviation processing means 890 when the banknote is loaded into the banknote storing and discharging bin 8 from the loading and unloading bin 9 or when the banknote is loaded into the loading and unloading bin 9.

In this embodiment, although explanation has been made of the deviation processing means 890 which is set up in the temporary storage bin 4, the deviation may be processed in the cash input/output port 2. Further, in this embodiment, although explanation has been made of the deviation processing means 890 which process a deviation of each of banknotes one by one, it may be also effective in the case of processing a deviation for banknotes in bundles or the like.

In this embodiment, although explanation has been made of the deviation processing means 890 which is set up in the temporary storage bin 4 in which banknotes are stored in its standing posture, it may be set up in a device in which banknotes are stored in its horizontal or oblique posture.

Even though a banknote to be stored has any posture, there may be incorporated a banknote pressing member for pressing the banknotes toward the deviation processing means 890 so that at least one side thereof makes contact with the deviation processing means 890.

In this embodiment, although explanation has been made of the deviation processing means 890 which is set up in the vicinity of only one side (lower side) of a banknote, the deviation processing means may also be set up in the vicinity of another side (upper side) of the banknote so as to apply a force or vibration for processing a deviation to a plurality of sides of the banknote.

In this embodiment, although explanation has been made of the deviation processing means 890 which processes banknotes stacked in the temporary storage bin 4, a deviation may be processed for banknotes which has been stored by a human hand into a cash box for accommodating banknotes, in the cash input/output port 2 or the like.

In this embodiment, explanation has been made of the sensors which are provided for detecting a deviation of a banknote conveyed into the temporary storage bin 4, sensors for detecting a deviation may be set in the temporary storage bin 4.

In this embodiment, although explanation has been made of the banknote handling apparatus for handling banknotes as an embodiment, the present invention may be applied for an apparatus for handling other various strip sheets such as checks, slips, or exchange tickets.

In this embodiment, as shown in FIG. 9, although the deviation processing means 890 has the portions which are projected from the bottom surface belt 807 and which are rotated toward the center of the apparatus, the deviation processing means 890 may be rotated in a direction reverse to the direction of the arrow 890*a*, or all deviation processing means 890 may be rotated in one and the same direction so as to displace the banknote in a direction which is not toward the center but outward. Further, the rotating direction may be selectively changed in accordance with a size of a banknote or a condition of a banknote, such as a direction in which a banknote is displaced toward the center or a direction in which a banknote is displaced outward.

That is, there may be previously carried out a deviation process which will be hereinbelow explained, with the use of the deviation processing means 890 incorporated in the temporary storage bin 4, for banknotes that are conveyed into the banknote storage bin 7 into which banknotes are only taken into, into the banknote storing and discharging bin 8 for storing banknotes of the same denomination, or into the loading and unloading bin 9.

FIGS. 11A, 11B and 11C are top views for explaining the condition that a deviation of a banknote in the temporary storage bin 4 has been processed.

Referring to FIGS. 11A to 11C, as stated above, the banknotes in the temporary storage bin 4 can be located at the center position of the banknote accommodation space, as shown in FIG. 11A. Meanwhile, when the banknote is stacked in the temporary storage bin 4, the deviation processing means 890 is rotated in one direction, and accordingly, the stacked banknote is displaced to one of the side walls 813 at which it comes to a stop. Then, when a following banknote is stacked, the deviation processing means 890 is rotated in a direction reverse to the previous direction, and accordingly, the banknote is displaced to the other one of the side walls 813 at which it comes to a stop. With the repetitions of the above-mentioned steps, the banknotes can be stored, being uniformly dispersed as shown in FIG. 11B.

Next, these dispersed banknotes are conveyed from the temporary storage bin 1 into the banknote storage bin 7, the banknote storing and discharging bin 8 or the loading and unloading bin 9, and accordingly, the banknotes can be stored being dispersed in the banknote storage bin 7, the banknote storing and discharging bin 8 or the loading and unloading bin 9. Namely, since the banknotes are dispersed, no large gap is present between the banknotes and a wall in the bin, and accordingly, the banknotes can be stored in order. Incidentally, although explanation has been made of the method that the banknotes are stacked while they are, one by one, displaced in opposite directions. The deviation may be processed by rotating the deviation processing means 890 in opposite directions, not for every banknote, but for every any number of banknotes, that is, for example, for every several banknotes, every several ten banknotes or the like.

Further, in addition to the method, as stated above, that the deviation is processed so as to disperse the banknotes, all banknotes are set along one of the side walls 813. Namely, when the banknotes are stacked in the temporary storage bin 4, the deviation processing means is rotated in one direction, and accordingly, the stacked banknote is displaced to one of the side walls 813 at which it comes to a stop. With the repetitions of these steps, the banknotes can be stored, being set on one side, as shown in FIG. 11C.

Next, these banknotes set on one side, are conveyed from the temporary storage bin 4 into the banknote storage bin 7, the banknote storing an discharging bin 8 or the banknote loading and unloading bin 9, and accordingly, the banknotes can be stored being set on one side in the banknote storage bin 7, the banknote storing and discharging bin 8 or the loading and unloading bin 9.

It is noted, in the method in which the banknotes are dispersed or in the method in which the banknotes are set on one side, that the rotation of the deviation processing means 890 may be stopped before a banknote to be processed for its deviation comes to the side wall 813 so as to process the deviation by the degree that the banknote is prevented from coming up to the side wall 813.

Further, the deviation processing means 890 may be incorporated in each of the banknote storage bin 7, the banknote storing and discharging bin 8 and the loading and unloading bin 9 in order to carry out the above-mentioned deviation process for banknotes in each bin.

Thus, according to this embodiment, there can be materialized the banknote handling apparatus for processing deviations of banknotes stored in a storage bin. Further, since the banknotes stored in the storage bin are not pinched by belts or rollers, in comparison with banknotes on conveyance, the deviations of the banknotes can be corrected with a higher degree of accuracy than that of banknotes during conveyance.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheet handling apparatus with a paper sheet storage bin having a top panel, side walls and a floor surface on which paper sheets to be stored are stacked, comprising:

a deviation processing means arranged on the floor surface for urging at least one of the paper sheets to adjust a longitudinal position of the at least one of the paper sheets so that a longitudinal central portion of the at least one of the paper sheets becomes within a predetermined distance of a central position of a cross section of the paper sheet storage bin, and a pressing means arranged for urging the at least one of the paper sheets to press at least one of the sides of the at least one of the paper sheets against the deviation processing means when the at least one of the paper sheets is transferred into the paper sheet storage bin or is stored in the paper sheet storage bin so that a frictional force between the at least one of the paper sheets and the deviation processing means is increased to urge the at least one of the paper sheets toward the central position of the cross section of the paper sheet storage bin;

wherein the deviation processing means includes a pair of rollers to contact an edge of at least one of the paper sheets, each roller including apexes which are projected from the floor surface and the pair rollers arranged on the left and right side of the central position;

a control unit configured to rotate the pair of rollers in respective directions opposite to each other so that the longitudinal central position of the at least one of the paper sheets is urged toward the central position of the cross section of the paper sheet storage bin.

2. The paper sheet handling apparatus according to claim 1, wherein the pressing means is elastically deformable.

3. The paper sheet handling apparatus according to claim 1, wherein the pressing means includes a flexible vane wheel elastically deformable.

4. The paper sheet handling apparatus according to claim 1, wherein the pressing means is arranged for urging the at least one of the paper sheets in an urging direction perpendicular to a stacking direction in which the paper sheets are stacked in the paper sheet storage bin.

5. The paper sheet handling apparatus according to claim 1, wherein the pressing means is arranged for urging the at least one of the paper sheets in an urging direction perpendicular to a juxtaposed direction in which the rollers are juxtaposed with each other.

* * * * *